US006591640B2

(12) United States Patent
Park

(10) Patent No.: US 6,591,640 B2
(45) Date of Patent: Jul. 15, 2003

(54) DAMPER FOR FULL AUTOMATIC WASHING MACHINE

(75) Inventor: Yong Suck Park, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/219,753

(22) Filed: Aug. 16, 2002

(65) Prior Publication Data

US 2002/0190448 A1 Dec. 19, 2002

Related U.S. Application Data

(63) Continuation of application No. 09/668,357, filed on Sep. 25, 2000, now Pat. No. 6,474,113.

(30) Foreign Application Priority Data

Oct. 11, 1999 (KR) ..... 99-43703
Oct. 11, 1999 (KR) ..... 99-43704
Oct. 11, 1999 (KR) ..... 99-43705
Oct. 11, 1999 (KR) ..... 99-43706

(51) Int. Cl.[7] ..... D06F 37/24
(52) U.S. Cl. ..... 68/23.3
(58) Field of Search ..... 68/23.1, 23.3; 188/129, 381; 248/638

(56) References Cited

U.S. PATENT DOCUMENTS 5,117,659 A 6/1992 Sharp et al. ..... 68/23.3
5,606,879 A 3/1997 Froelicher et al. ..... 68/23.3
5,884,891 A 3/1999 Hawkins et al. ..... 248/613
5,946,946 A 9/1999 Sharp et al. ..... 68/23.1

FOREIGN PATENT DOCUMENTS

| | | |
|---|---|---|
| EP | WO 96/37651 | 11/1996 |
| EP | 0915196 A1 | 5/1999 |
| JP | 54-47374 | 4/1979 |
| JP | 4-50744 | 4/1992 |
| JP | 84382 | 4/1993 |
| JP | 8-10489 | 1/1996 |
| JP | 11033276 | 2/1999 |
| JP | 5-96086 | 4/1999 |

*Primary Examiner*—Philip R. Coe
(74) *Attorney, Agent, or Firm*—Fleshner & Kim, LLP

(57) ABSTRACT

Damper for a full automatic washing machine including an upper buffering member fitted to an inside of an upper portion of a washing machine housing, an elastic member under the lower buffering member for elastic supporting of the lower buffering member, and a damper bar for passing through, and connecting the upper buffering member, the lower buffering member, and the elastic member in succession, for damping vibration and impact, wherein the upper buffering member has a through hole for passing the damper bar therethrough with an upper diameter equal to, or smaller than a diameter of the damper bar, a lower diameter greater than a diameter of the damper bar, and the lower buffering member has an extension projected upward from an upper surface, a plurality of reinforcing ribs in an upper portion of the extension, sloped guide ribs extended downward from a bottom thereof for preventing the lower buffering member from coming out of a top of the elastic member, and a hole for passing the damper bar therethrough, with an etched rugged inside surface for containing grease.

25 Claims, 6 Drawing Sheets

DAMPER FOR FULL AUTOMATIC WASHING MACHINE

This application is a Continuation or U.S. patent application Ser. No. 09/668,357, filed Sep. 25, 2000, and now U.S. Pat. No. 6,474,113.

BACKGROUND OF THE INVENTION

1. Field of the Invention

The present invention relates to a full automatic washing machine, and more particularly, to a damper for a full automatic washing machine, which is fitted between a housing and an outer tub of the full automatic washing machine for absorbing, and damping vibration from the outer tub.

2. Background of the Related Art

A related art full automatic washing machine, which carries out all cycles starting from washing to rinsing and spinning automatically, will be explained with reference to FIGS. 1 and 2.

Referring to FIG. 1, the related art full automatic washing machine is provided with a housing 1 having an upper hanger 11 on an upper inside portion, an outer tub 2 having a lower hanger 21 on an outside lower portion and fastened to an inside of the housing 1 for storing washing water, an inner tub 3 rotatably mounted in the outer tub 2 and having a pulsator (not shown) on a bottom for circulating washing water to wash laundry, and a damper 4 fitted between the lower hanger 21 on the outer tub 2 and the upper hanger 11 on the housing 1 for absorbing, and damping vibration and impact from the outer tub 2.

In the meantime, referring to FIG. 2, the damper 4 is provided with a damper bar 41 having upper and lower holders 41*a* and 41*b* at upper and lower ends and a caulking part 41*c* on an upper portion, an upper buffering member 42 caught at the upper hanger 11 on the housing 1 having a through hole 42*a* at a center for pass through of the damper bar 41, a lower buffering member 43 caught at the lower hanger 21 on the outer tub 2 having an operating hole 43*a* at a center for pass through of the damper bar 41, and a longitudinal cut-away slot 43*c* for permitting radial contraction to bring the operating hole 43*a* into frictional contact with the damper bar 41, a support plate 46 fitted to a lower end of the damper bar 41 such that fall off of the support plate 45 is prevented by the lower holder 41*b*, a compression coil spring 44 fitted between the support plate 46 and the lower buffering member 43 as an elastic member for elastic supporting of the lower buffering member 43 so that the coil spring is compressed and expanded against vibration and impact transmitted from the outer tub 2 for absorbing the vibration and impact, and a buffer tube 45 fitted to surround the compression coil spring 44 for generating friction force during the compression and expansion of the compression coil spring 44. Therefore, if there is vibration occurred in the washing machine during washing, the vibration is transmitted to the damper 4 through the outer tub 2, and the damper 4 absorbs, and attenuates the vibration by the friction between the lower buffering member 43 and the damper bar 41 and compression and expansion of the compression coil spring 44.

However, the related art damper having the foregoing action has the following problems in view of the structure.

First, in assembly of the damper 4 to the housing 1, under a state a driving device (not shown) and the inner tub 3 are assembled to the outer tub 2, the lower buffering member 43 of the damper 4 is fixed to the lower hanger 21, the housing 1 is covered on the outer tub 2, and the upper buffering member 42 of the damper 4 is fixed to the upper hanger 11, thereby fixing the outer tub 2 to the housing 1. The fixing of the upper buffering member 42 of the damper 4 fixed to the outer tub 2 to the housing 1 is carried out by hand, wherein there are cases frequently occurred, in which the upper buffering member 42 is slipped down to a bottom side by its own weight in a state before the upper buffering member 42 of the damper 4 is fixed to the upper hanger 11 on the housing 1 because there is a slight gap between the through hole 42*a* in the upper buffering member 42 of the damper 4 and the damper bar 41, with grease applied in the gap for prevention of wear. In this instance, the worker should put his hand through a narrow gap between the housing 1 and the outer tub 2 to reach to the bottom side of the washing machine, pull up the upper buffering member 42, and fix to the upper hanger 11 of the housing 1. In order to solve such a problem in the related art, though the caulking part 41*c* is formed on the upper portion of the damper bar 41, for catching the upper buffering member 42 so that the upper buffering member 42 is prevented from coming down any more, the formation of the caulking part 41*c* on the damper bar 41 requires additional fabrication process.

In the meantime, in the full automatic washing machine, there are cases when the outer tub 2 hits inside of the housing 1 due to strong vibration caused by weight of the inner tub 3 itself and the washing water and laundry, if the washing machine is forcibly stopped suddenly. When the outer tub 2 thus hits inside of the housing 1, the impact is transmitted to the lower hanger 21 as it is, to break the lower buffering member 43 as the lower buffering member 43 in a hole 21*a* of the lower hanger 21 hits onto an inside circumference of the hole 21*a*. Accordingly, in order to solve the foregoing problems in the related art, a thickness of the lower buffering member 43 is formed thicker, only to increase a possibility of breakage, though the lower buffering member 43 becomes the stronger, and to deteriorate an accuracy of the hole 43*a* to increase a probability of causing defects due to shrinkage in injection molding.

And, the related art damper has a problem in that there are cases when the lower buffering member comes out of the compression coil spring 44. That is, an eccentric load occurred in the inner tub 3 increases an amplitude of up and down direction vibration of the inner tub 3 and the outer tub 2, together with an amplitude increase of the damper 4, wherein, as shown in FIG. 3, if the damper 4 vibrates excessively, the lower buffering member 43 comes out of the compression coil spring 44, and sits on a top end of the compression coil spring 44, coming down inside of the coil spring no more.

In the meantime, though there is grease applied in the gap between the hole 43*a* of the lower buffering member 43 and the damper bar 41 for prevention of wear of the hole 43*a*, the gap is made to be tight for providing an adequate friction between the lower buffering member 43 and the damper bar 41, which can not contain a sufficient amount of grease. In addition to the lack of grease, the heat caused by friction between the lower buffering member 43 and the damper bar 41 drops viscosity of the grease, such that the grease flows down along the damper bar 41, that causes to leave almost no grease in the gap in prolonged use.

SUMMARY OF THE INVENTION

Accordingly, the present invention is directed to a damper for a full automatic washing machine that substantially obviates one or more of the problems due to limitations and disadvantages of the related art.

An object of the present invention is to provide a damper for a full automatic washing machine, which can prevent falling down of an upper buffering member of the damper from an upper end of the damper bar without addition of a member, such as the caulking part, for improving workability, and damage to a lower buffering member of the damper even if an excessive force caused by a sudden stop of the inner tub and the like is applied to the damper.

Another object of the present invention is to provide a damper for a full automatic washing machine, which can prevent the lower buffering member from coming out of the elastic member even if the inner tub and the outer tub vibrate excessively due to an eccentric force occurred in the inner tub.

Other object of the present invention is to provide a damper for a full automatic washing machine, which can hold the grease applied to the gap between the damper bar and the hole of the lower buffering member for a long time, maintain a damping capability of the damper constant, and prevent wear down of the hole in the lower buffering member.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the damper for a full automatic washing machine includes an upper buffering member fitted to an inside of an upper portion of a washing machine housing, an elastic member under the lower buffering member for elastic supporting of the lower buffering member, and a damper bar for passing through, and connecting the upper buffering member, the lower buffering member, and the elastic member in succession, for damping vibration and impact, wherein the upper buffering member has a through hole for passing the damper bar therethrough with an upper portion diameter equal to or smaller than a diameter of the damper bar, and a lower portion diameter greater than the diameter of the damper bar, and the lower buffering member has an extension projected upward from the upper surface.

And, the lower buffering member has a plurality of reinforcing ribs in an upper portion of the extension, sloped guide ribs extended downward from a bottom thereof for preventing the lower buffering member from coming out of a top of the elastic member, and a hole for passing the damper bar therethrough, with an etched rugged inside surface for containing grease.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
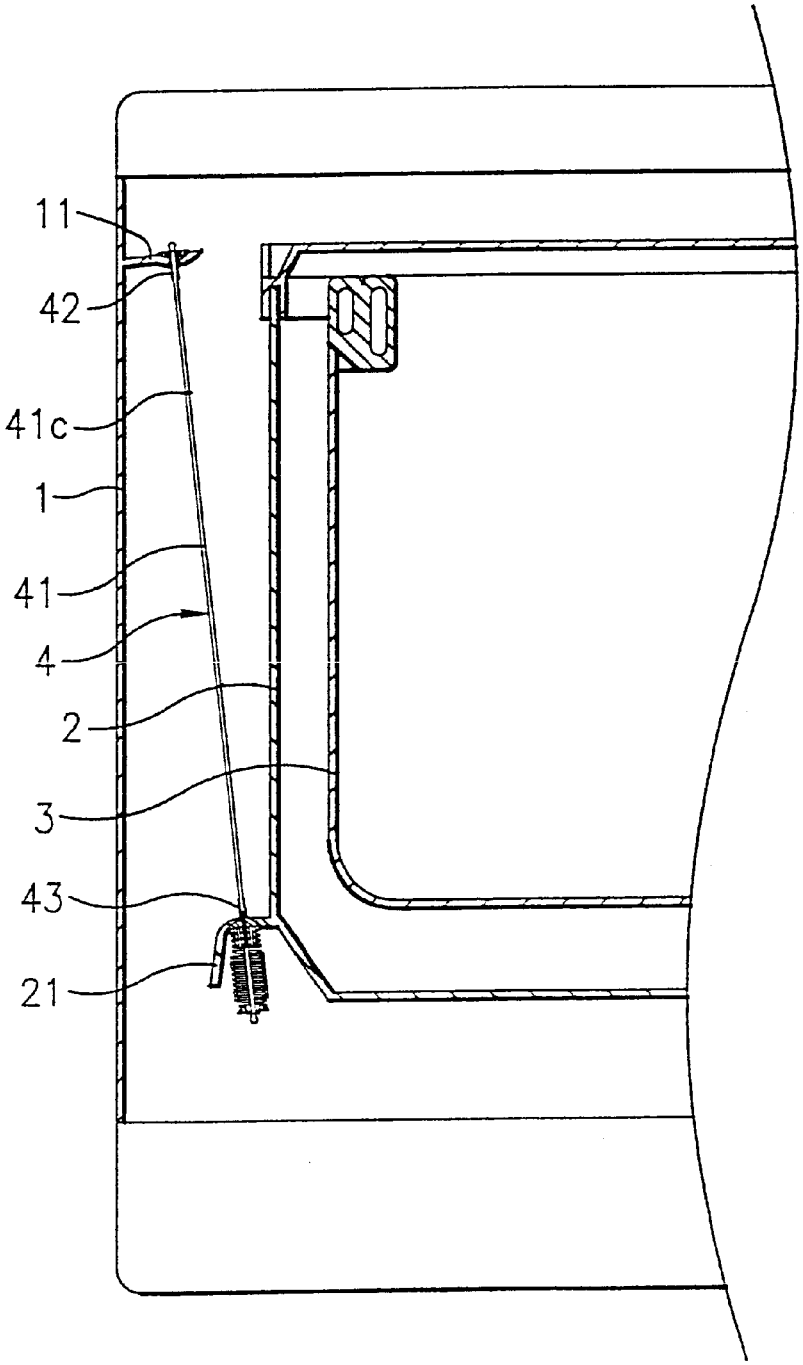
FIG. 1 Prior Art
FIG. 1 illustrates a section of a half of a related art full automatic washing machine.
Figure 2:
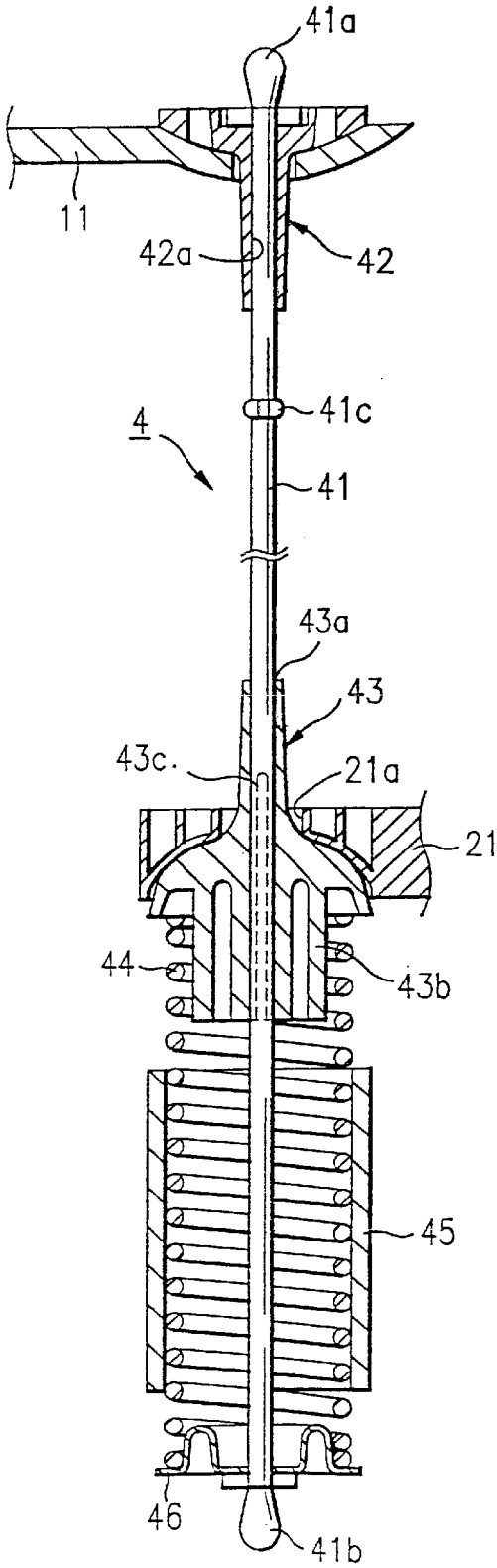
FIG. 2 Prior Art
FIG. 2 illustrates a section of a related art damper.
Figure 3:
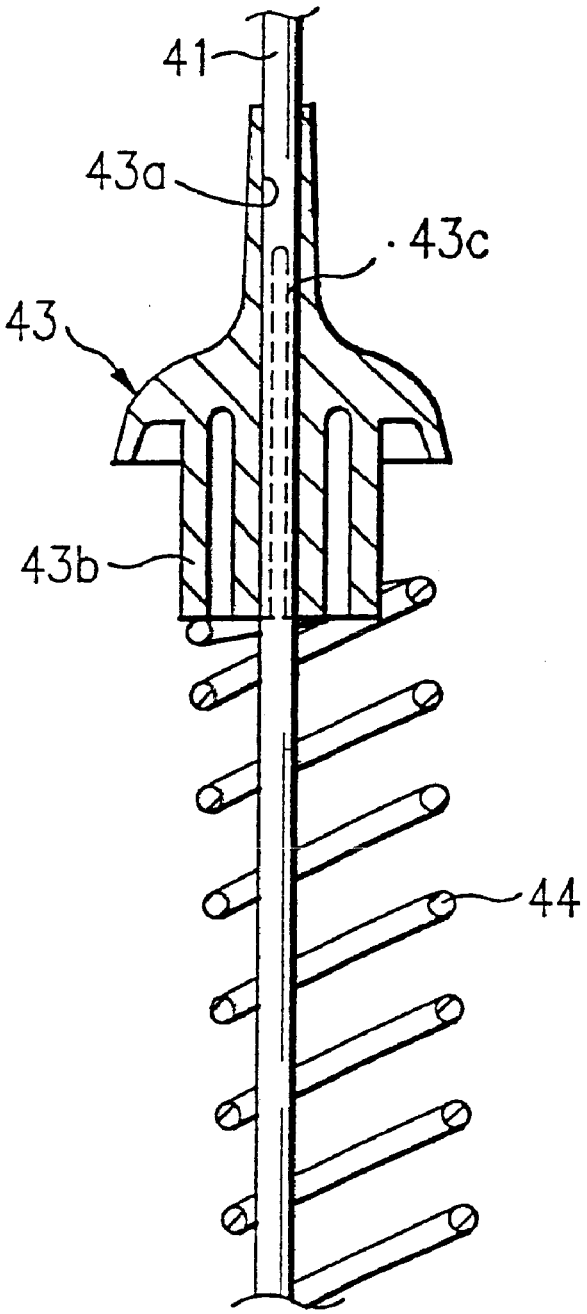
FIG. 3 Prior Art
FIG. 3 illustrates a section showing a lower buffering member in the damper in FIG. 2 come out of a compression coil spring.
Figure 4:
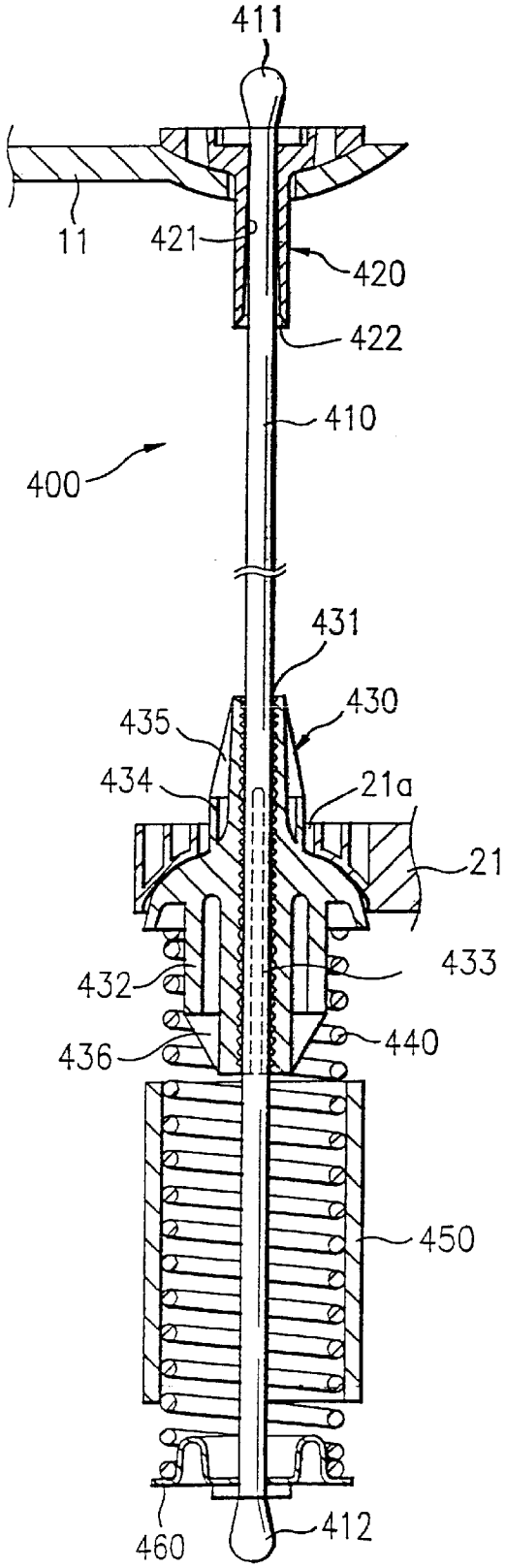
FIG. 4 illustrates a section of a damper for a full automatic washing machine in accordance with a preferred embodiment of the present invention.
Figure 5:
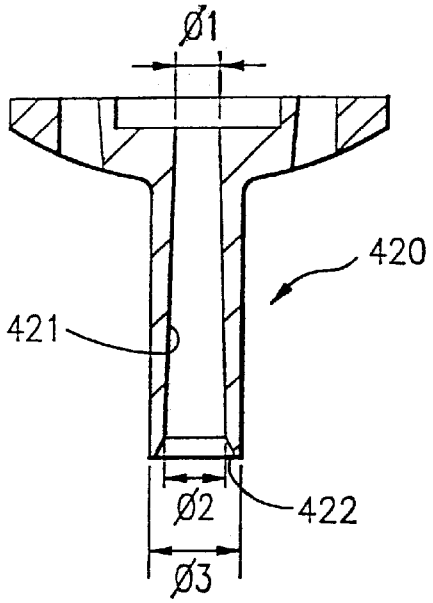
FIG. 5 illustrates a section of an upper buffering member of a damper for a full automatic washing machine in FIG. 4.
Figure 6:
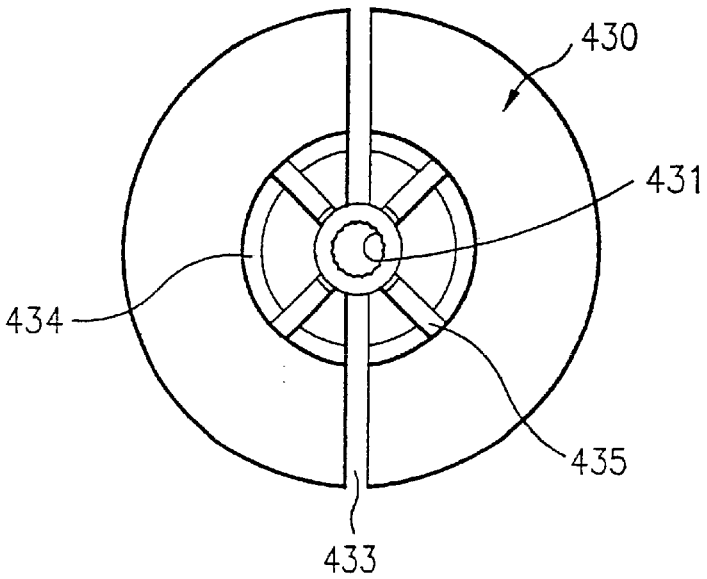
FIG. 6 illustrates a plan view of a lower buffering member of a damper for a full automatic washing machine in FIG. 4; and, FIG. 7 illustrates a bottom view of a lower buffering member of a damper for a full automatic washing machine in FIG. 4.
Figure 7:
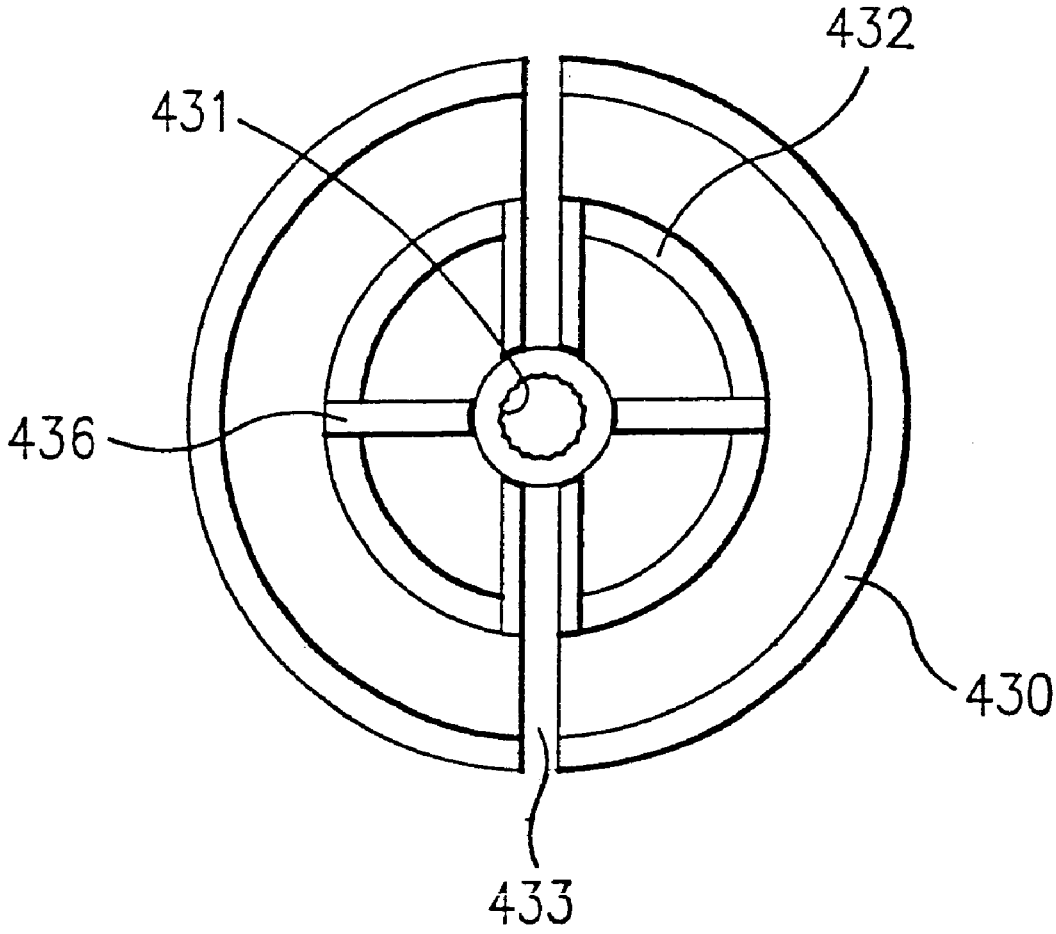

Referring to FIGS. 4~7, a damper 400 for a full automatic washing machine in accordance with a preferred embodiment of the present invention includes a damper bar 410 having upper and lower holders 411 and 412 at top and bottom ends thereof, an upper buffering member 420 inserted through the damper bar 410, fixed to a top end of the damper bar 410, and caught by an upper hanger 11 on an upper portion of inside of a housing 1 (see FIG. 1), a lower buffering member 430 inserted through the damper bar 410, and caught in a hole 21*a* of a lower hanger 21 on a lower portion of outside of an outer tub 2 (see FIG. 1), a support plate 460, and a support plate 460 inserted through the damper bar 410 and fixed to a bottom end of the damper bar 410. And, there is a compression coil spring 440, an elastic member, between the lower buffering member 430 and the support plate 460 for elastic supporting of the lower buffering member 430, and a hollow buffering tube 450 on an outer circumference of the compression coil spring 440 to surround a portion of the compression coil spring 440. The upper buffering member 420 of a funnel form has a through hole 421 at a center for pass through of the damper bar 410. The through hole 421 has an upper diameter $\phi$1 equal to or smaller than a diameter of the damper bar 410 which gradually becomes the greater as it goes downward until it reaches to a lower diameter $\phi$2, which is expanded with a slope 422 into a lowermost diameter $\phi$3 at a lowermost end thereof for easy insertion of the upper buffering member 420 from the upper end of the damper bar 410 in assembly of the damper. On the other hand, the lower buffering member 430 has a cylindrical boss 432 for insertion in an upper portion of the compression coil spring 440, one pair of opposite longitudinal cut away slots 433 from an upper portion to a bottom thereof to open at the bottom, and a hole 431 at a center for pass through of the damper bar 410. The lower buffering member 430 has a cylindrical extension 434 projected upward from a middle portion with a diameter to leave a small gap with the hole 21*a* in the lower hanger 21, and a plurality of sloped reinforcing ribs on an upper portion of, and at fixed intervals around the cylindrical extension 434 to converge in an upper direction. And, there are a plurality of guide ribs 436 extended from a bottom of the boss 432 of the lower buffering member 430 and sloped from an outside of upper portion to an inside of lower portion around the boss 432 at fixed intervals. That is, the guide ribs 436 converge downward. And, an inside surface of the hole 431 at the center of the lower buffering member 430 is rugged for containing grease applied thereto for a long time, preferably formed by etching.

The operation of the damper for full automatic washing machine in accordance with a preferred embodiment of the present invention will be explained.

In making circulation of washing water to wash laundry by rotating the pulsator (not shown) in the inner tub 3 in regular and reverse direction by means of a driving device (not shown) in operation of the full automatic washing machine, vibration is occurred from the rotation of the driving device, and motion of the washing water in the inner tub 3 and the laundry, which is transmitted to the lower buffering member 430 of the damper 400 through the outer tub 2 and the lower hanger 21 on the outer tub 2. Once vibration occurred thus, the lower buffering member 430 causes friction with the damper bar 410 to dampen the vibration as the lower buffering member 430 contracts in a radial direction along the cut away slots 433 to compress the damper bar 410, the compression coil spring 440 under the lower buffering member 430 is compressed and expanded, to attenuate the vibration, and rest of the vibration, which is not attenuated still by the lower buffering member 430 and the compression coil spring 440, is transmitted to the damper bar 410 through the support plate 460, and is dispersed as the vibration is transmitted to the upper buffering member 420 at the top of the damper bar 410 and the upper hanger 11 on the housing 1 (see FIG. 1). When the compression coil spring 440 is compressed and expanded, an outer circumference of the compression coil spring 440 and an inner circumference of the buffering tube 450 are brought into contact and causes friction, to double the attenuation.

During the process of attenuation at the damper 400, the lower buffering member 430 dampens the vibration as the cylindrical extension 434 of the lower buffering member 430 hits onto the hole 21*a* in the lower buffering member 21, wherein, as explained, the minimized gap between the cylindrical extension 434 of the lower buffering member 430 and the hole 21*a* in the lower hanger 21, with a reduced movement, reduces an impact to the lower buffering member 430 though a strong vibration caused by a sudden stop of the washing machine is transmitted thereto, and reinforcement of an overall strength of the lower buffering member 430 by the plurality of ribs 435 on the upper portion of the cylindrical extension 434 prevents the lower buffering member 430 from damage. And, in a case when the lower buffering member 430 has a great up and down amplitude caused by eccentric rotation come from eccentric load of the inner tub 3, almost to cause the boss 432 of the lower buffering member 430 to come out of the compression coil spring 440, the guide ribs 436 on the bottom of the boss 432 prevents the lower buffering member 430 from coming out of the compression coil spring 440, but returns the lower buffering member 430 to an original position, permitting to continue the damping operation.

And, the etched rugged inside surface of the hole 431 in the lower buffering member 430 can contain grease for a long time without leakage to outside of the gap even in prolonged use. That is, etched rugged surface both increases a grease storage space and acts as a resistor for preventing an easy flow down of the grease.

In the meantime, the strong compression by the upper buffering member 420 onto the damper bar 410 at the upper portion of the through hole 421 during assembly of the damper 400 of the present invention prevents the upper buffering member 420 from slipping down below the damper bar 410 by weight of the upper buffering member 420.

As has been explained, the damper for a full automatic washing machine has the following advantages.

The prevention of slipping down of the upper buffering member of the damper along the damper bar permits an easy assembly of the damper to the washing machine housing. The expanded portion at the bottom of the through hole in the upper buffering member permits an easy assembly of the upper buffering member to the damper bar.

The provision of the cylindrical extension and the reinforcement ribs in an upper portion of the upper buffering member prevents breakage of the lower buffering member even if a strong vibration from a sudden stop of the washing machine is concentrated onto the lower buffering member.

The prevention of the lower buffering member coming out of the elastic member by means of the guide ribs formed on a bottom of the lower buffering member permits a stable coupling of the lower buffering member with the elastic member, to continue the attenuation action of the damper.

The etched rugged inside surface of the hole in the lower buffering member of the present invention permits to maintain an attenuating capability of the damper almost constant even in a prolonged use of the washing machine, that give the user a reliability of a vibration system of the washing machine.

It will be apparent to those skilled in the art that various modifications and variations can be made in the damper for a full automatic washing machine of the present invention without departing from the spirit or scope of the invention. Thus, it is intended that the present invention cover the modifications and variations of this invention provided they come within the scope of the appended claims and their equivalents.

What is claimed is:

1. A washing machine, comprising:

a housing;

an outer tub installed in the housing and configured for storing washing water;

a damper for attenuating a vibration generated in the housing and the outer tub, the damper comprising:

a damper bar attached between the housing and the outer tub, an upper buffering member configured to attach to the housing and comprising a through hole which allows the damper bar to pass therethrough, a lower buffering member configured to attach to the outer tub and comprising a through hole which allows the damper bar to pass therethrough, the lower buffering member further comprising an extension that projects upward from a main body of the lower buffering member, wherein a plurality of reinforcing ribs are formed on the extension; and an elastic member positioned under the lower buffering member and configured to elastically support the lower buffering member.

2. The washing machine according to claim 1, wherein a plurality of guide ribs are formed on a bottom surface of the lower buffering member.

3. The washing machine according to claim 2, wherein a sloped surface is formed on each guide rib of the plurality of guide ribs.

4. The washing machine according to claim 1, wherein the through hole of the lower buffering member has an inner surface that is configured to retain a lubricant.

5. The washing machine according to claim 4, wherein the inner surface is roughened.

6. The washing machine according to claim 5, wherein the roughened surface is formed by etching.

7. The washing machine according to claim 1, wherein the damper further comprises a buffer tube which surrounds the elastic member and slidably contacts the elastic member.

8. The washing machine according to claim 1, wherein the damper further comprises a support plate configured to be mounted at a lower part of the damper bar and to support the elastic member.

9. A damper for a washing machine, comprising:

a damper bar attached between a housing and an outer tub;

an upper buffering member configured to attach to the housing and comprising a through hole which allows the damper bar to pass therethrough;

a lower buffering member configured to attach to a lower hanger of the outer tube and comprising a through hole which allows the damper bar to pass therethrough, the lower buffering member further comprising a cylindrical extension that projects upward from a curved surface of the lower buffering member, wherein the cylindrical extension is inserted into a coupling hole formed in the lower hanger so as to minimize a gap between the lower buffering member and the coupling hole of the lower hanger; and an elastic member positioned under the lower buffering member and configured to elastically support the lower buffering member.

10. The damper according to claim 9, wherein a plurality of reinforcing ribs are formed on the cylindrical extension.

11. The damper according to claim 9, wherein a plurality of guide ribs are formed on a bottom surface of the lower buffering member.

12. The damper according to claim 11, wherein a sloped surface is formed on each guide rib of the plurality of guide ribs.

13. The damper according to claim 9, wherein the through hole of the lower buffering member comprises an inner surface that is configured to retain a lubricant.

14. The damper according to claim 13, wherein the inner surface is roughened.

15. The damper according to claim 14, wherein the roughened surface is formed by etching.

16. The damper according to claim 9, further comprising a buffer tube which surrounds the elastic member and slidably contacts the elastic member.

17. The damper according to claim 9, further comprising a support plate configured to be mounted at a lower part of the damper bar and to support the elastic member.

18. A damper for a washing machine, comprising:

a damper bar configured to be attached between a housing and an outer tub;

an upper buffering member configured to attach to the housing and comprising a through hole which allows the damper bar to pass therethrough;

a lower buffering member configured to attach to a lower hanger of the outer tub and comprising a through hole which allows the damper bar to pass therethrough, the lower buffering member comprising an upper part being in contact with the lower hanger of the outer tub, a cylindrical boss extended downward from the upper part, and an air buffering zone formed in the boss; and an elastic member positioned under the lower buffering member and configured to elastically support the lower buffering member, wherein a plurality of guide ribs, each with a sloped surface, extend downward from a bottom of the cylindrical boss and are configured to retain the lower buffering member in the elastic member.

19. The damper according to claim 18, wherein the through hole of the lower buffering member comprises an inner surface that is configured to retain a lubricant.

20. The damper according to claim 19, wherein the inner surface is roughened.

21. The damper according to claim 20, wherein the roughened surface formed by etching.

22. The damper according to claim 19, further comprising a buffer tube which surrounds the elastic member and slidably contacts the elastic member.

23. The damper according to claim 19, further comprising a support plate configured to be mounted at a lower part of the damper bar and to support the elastic member.

24. A damper for a washing machine, comprising:

a damper bar configured to be attached between a housing and an outer tub;

an upper buffering member configured to attach to the housing and comprising a through hole which allows the damper bar to pass therethrough;

a lower buffering member configured to attach to the outer tub and comprising a through hole which allows the damper bar to pass therethough, wherein the through hole of the lower buffering member comprises an inner surface that is configured to retain a lubricant, wherein the inner surface is roughened by etching; and an elastic member positioned under the lower buffering member and configured to elastically support the lower buffering member.

25. A washing machine; comprising:

a housing;

at least two upper hangers, each installed at a respective corner part of the housing;

an outer tub installed in the housing and configured for storing washing water;

at least two lower hangers fixed to the outer tub in correspondence with each upper hanger, respectively;

a damper comprising:

a damper bar configured to be attached between the housing and the outer tub;

an upper buffering member configured to attach the housing and comprising a through hole which allows the damper bar to pass therethrough, wherein the through hole has a non-uniform diameter such that only an upper portion of the upper buffering member contacts the damper bar along the through hole to prevent the upper buffering member form slipping down along the damper bar due to self weight;

a lower buffering member to attenuate a vibration generated between the housing and the outer tub configured to attach to the outer tub and comprising a through hole which allows the damper bar to pass therethrough, the lower buffering member further comprising a cylindrical extension that projects upward from a main body of the lower buffering member, wherein a plurality of reinforcing ribs are formed on the cylindrical extension; and an elastic member positioned under the lower buffering member and configured to elastically support the lower buffering member.

* * * * *